US006688371B2

(12) United States Patent
Rutan et al.

(10) Patent No.: US 6,688,371 B2
(45) Date of Patent: Feb. 10, 2004

(54) GLIDE ASSEMBLY FOR WALL PANEL ARRANGEMENT AND METHOD OF ASSEMBLING

(75) Inventors: Fred E. Rutan, Holland, MI (US); Nicholas Fricano, Grand Haven, MI (US); Mark R. Smith, Zeeland, MI (US); Jonathan R. DeYoung, Grand Rapids, MI (US); Scott J. Leenstra, Caledonia, MI (US)

(73) Assignees: Haworth, Inc., Holland, MI (US); Innotec Corporation, Zeeland, MI (US)

( * ) Notice: Subject to any disclaimer, the term of this patent is extended or adjusted under 35 U.S.C. 154(b) by 54 days.

(21) Appl. No.: 10/159,956

(22) Filed: May 30, 2002

(65) Prior Publication Data

US 2003/0221383 A1 Dec. 4, 2003

(51) Int. Cl.[7] ..... A47G 5/00

(52) U.S. Cl. ..... 160/135; 248/222.52; 403/348; 403/274; 52/239

(58) Field of Search ..... 160/135, 351; 248/222.52; 403/348, 274; 52/239, 36.1; 16/29, 43

(56) References Cited

U.S. PATENT DOCUMENTS

| | | | | | |
|---|---|---|---|---|---|
| 1,102,079 | A | * | 6/1914 | Rizer | 174/183 |
| 2,949,692 | A | * | 8/1960 | Kuhn | 446/69 |
| 3,532,369 | A | * | 10/1970 | Reilly | 403/176 |
| 3,733,759 | A | | 5/1973 | Schulte et al. | |
| 3,877,191 | A | | 4/1975 | Munsey | |
| 4,229,917 | A | | 10/1980 | Textoris et al. | |
| 4,770,560 | A | * | 9/1988 | Ott | 403/296 |
| 4,991,365 | A | | 2/1991 | Jackson | |
| 5,142,734 | A | | 9/1992 | Looman et al. | |
| 6,112,485 | A | * | 9/2000 | Beyer et al. | 52/239 |
| 6,397,533 | B1 | * | 6/2002 | Hornberger et al. | 52/239 |

FOREIGN PATENT DOCUMENTS

| | | | |
|---|---|---|---|
| JP | 2-90134 | * | 2/1990 |

* cited by examiner

*Primary Examiner*—Blair M. Johnson
(74) *Attorney, Agent, or Firm*—Flynn, Thiel, Boutell & Tanis, P.C.

(57) ABSTRACT

A glide assembly for a space-dividing wall panel arrangement including a housing which is mounted within a lower open end of an upright support element associated with a wall panel assembly, and a stem which projects downwardly from the housing for supportive engagement with a floor. The housing includes a lock plate which defines thereon projections which wedgingly engage within correspondingly located openings in the support element. Tabs are provided on the support element which are deformed during assembly so as to engage the respective projections and prevent disengagement of the glide assembly from the support element.

21 Claims, 5 Drawing Sheets

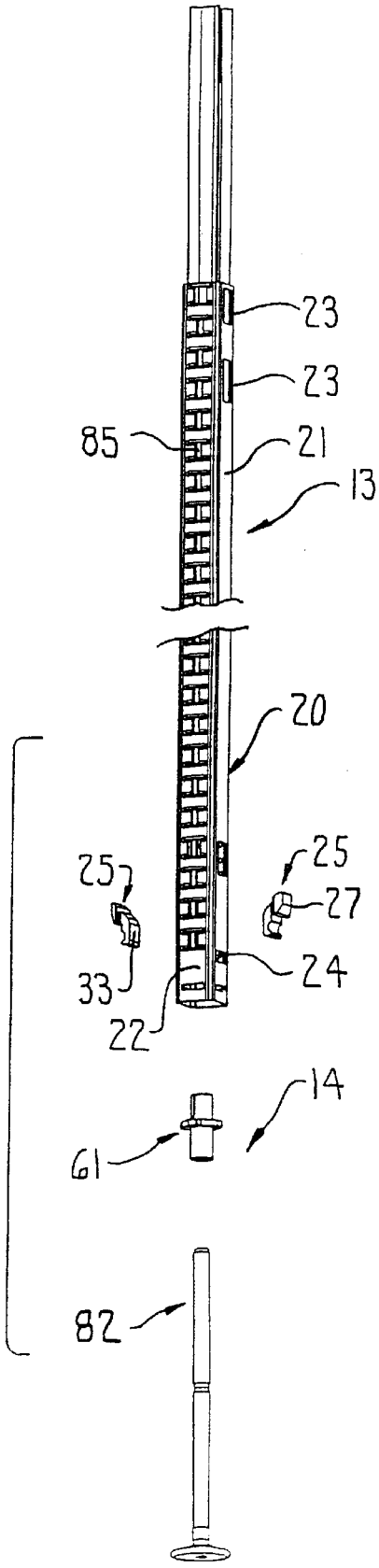
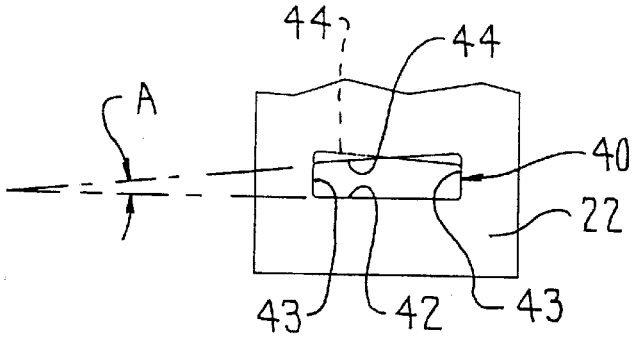
FIG. 3
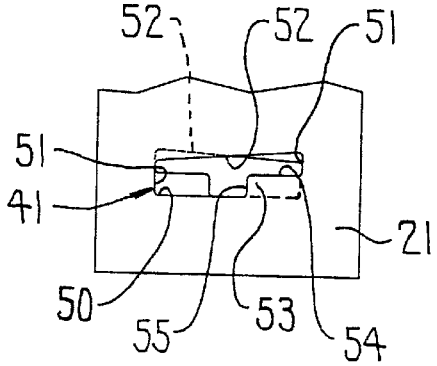
FIG. 4
FIG. 2

FIG. 11
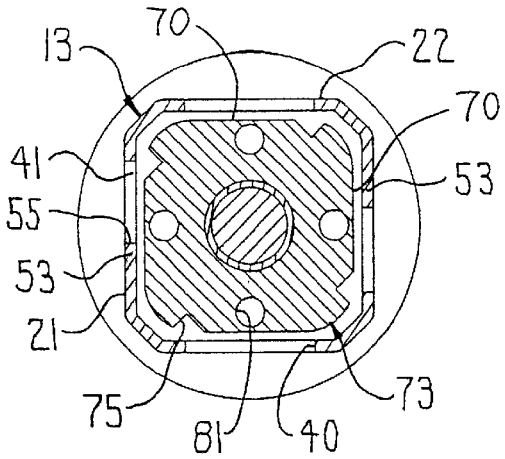
FIG. 12
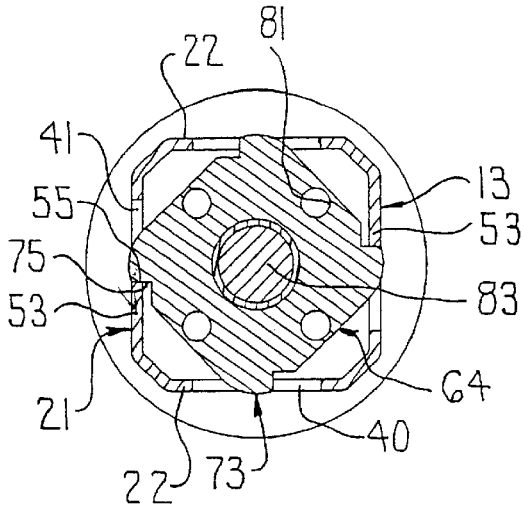
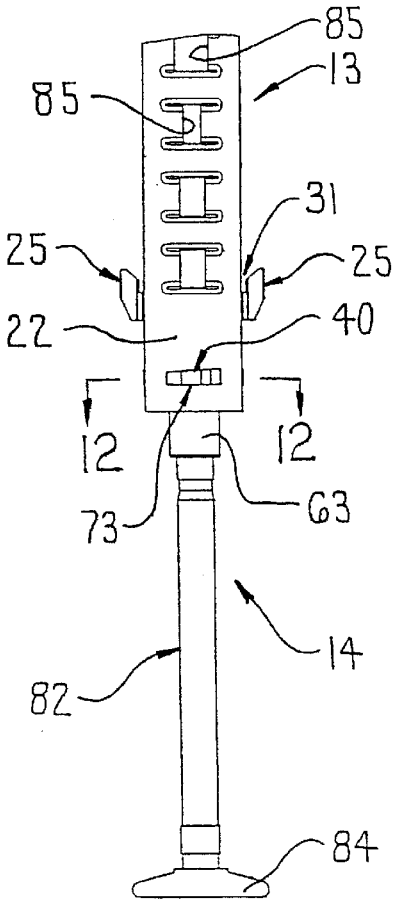
FIG. 9
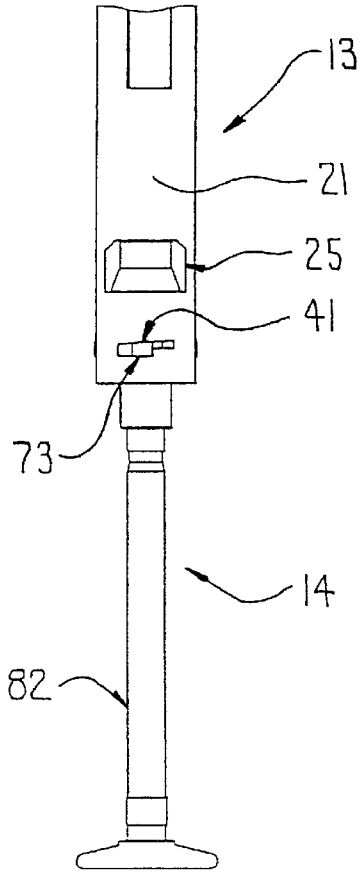
FIG. 10

GLIDE ASSEMBLY FOR WALL PANEL ARRANGEMENT AND METHOD OF ASSEMBLING

FIELD OF THE INVENTION

This invention generally relates to a glide assembly for supporting an article, and more particularly to a glide assembly for supporting a space-dividing wall panel arrangement.

BACKGROUND OF THE INVENTION

Numerous wall panel systems have been developed for use in dividing large open office areas into smaller work spaces. The wall panel system is typically formed from a plurality of individual upright wall panels which are appropriately joined together either directly or through intermediate connecting structures, such as upright connector or support posts. The wall panels are appropriately arranged into desired geometrical configurations to define work spaces for individual occupants. In this regard, the individual wall panels conventionally join in aligned relationship, and also traditionally connect at corners which define two, three or four-panel connections. Such wall panels are typically less than floor-to-ceiling height, and cooperate with other furniture components to define an equipped workstation. These components may include worksurfaces, cabinets, shelf units and the like which mount directly on and are supported by the wall panels, and may also include freestanding furniture components such as tables, chairs and file cabinets.

In known panel arrangements, the individual panel assemblies have a variety of configurations. For example, in some arrangements, the individual panels are supported directly in load-bearing relationship with a floor by glides or support feet. In other arrangements, serially-adjacent panel assemblies are interconnected through intermediate upright supports or connector posts which bear the weight of the panels and in turn are maintained in load-bearing engagement with the floor. The present invention is illustrated herein in conjunction with this latter type of panel arrangement, however, it will be appreciated that the invention is also applicable to panels supported directly on the floor, as well as to other structures which utilize this type of support.

In some arrangements, the support foot or glide is fixed to the connector post or directly to the frame of the panel assembly by welding, through a threaded engagement or other type of positive connection. For example, U.S. Pat. No. 5,142,734 illustrates a tubular glide support assembly with an upper portion defining therein axially extending lances. When the tube is driven into the panel assembly, the lances cut grooves into the wall of the panel bore in order to prevent rotation of the tube relative thereto. U.S. Pat. No. 3,877,191 discloses a support post which mounts therein a plug-like member at a lower end thereof. The lower end of the post defines splines or serrations which grip raised ribs defined on the plug-like member to retain same in the post. The plug-like member additionally includes a threaded interior opening which receives a threaded floor-engaging leveler.

It is an object of the invention to provide an improved glide assembly for load-bearing engagement with a support surface such as a floor, such as those used in space-dividing wall panel systems. The glide assembly according to the invention includes a housing from which a glide stem projects downwardly for engagement with the floor. A lock plate is provided on the housing and includes outwardly projecting noses which cooperate with corresponding openings defined in a support, such as a connector post utilized to interconnect adjacent panel assemblies, or alternatively a frame member of a panel assembly. The glide stem is threadingly engaged within the housing to allow for height adjustment of the support relative to the glide assembly. During assembly, the housing is inserted into a lower open end of the support, and the housing is rotated which causes positive engagement of the noses of the lock plate in the openings of the support to lock the glide assembly thereto. The assembly of the glide assembly to the support is thus greatly simplified, as no welding or other type of securement is necessary.

Other objects and purposes of the invention will be apparent to persons familiar with arrangements of this general type upon reading the following specification and inspecting the accompanying drawings.

BRIEF DESCRIPTION OF THE DRAWINGS

FIG. 2 is an enlarged exploded view of a wall panel connector post incorporating the glide assembly according to the invention;

FIG. 3 is an enlarged fragmentary view of the lower end of the connector post shown in FIG. 2;

FIG. 4 is an enlarged fragmentary view of the end of the connector post rotated 90 degrees from the position illustrated in FIG. 3;

FIG. 9 is an enlarged fragmentary view of the lower end of the connector post and glide assembly;

FIG. 10 is an enlarged fragmentary view of the connector post and glide assembly rotated 90 degrees from the position illustrated in FIG. 9;

FIG. 11 is an enlarged transverse cross-sectional view of the connector post and glide assembly during mounting of the glide assembly to the connector post;

FIG. 12 is an enlarged transverse cross-sectional view of the connector post and glide assembly similar to FIG. 11, but taken generally along line 12—12 in FIG. 9 after the locking plate of the glide assembly is locked into position within the connector post.

Figure 1:
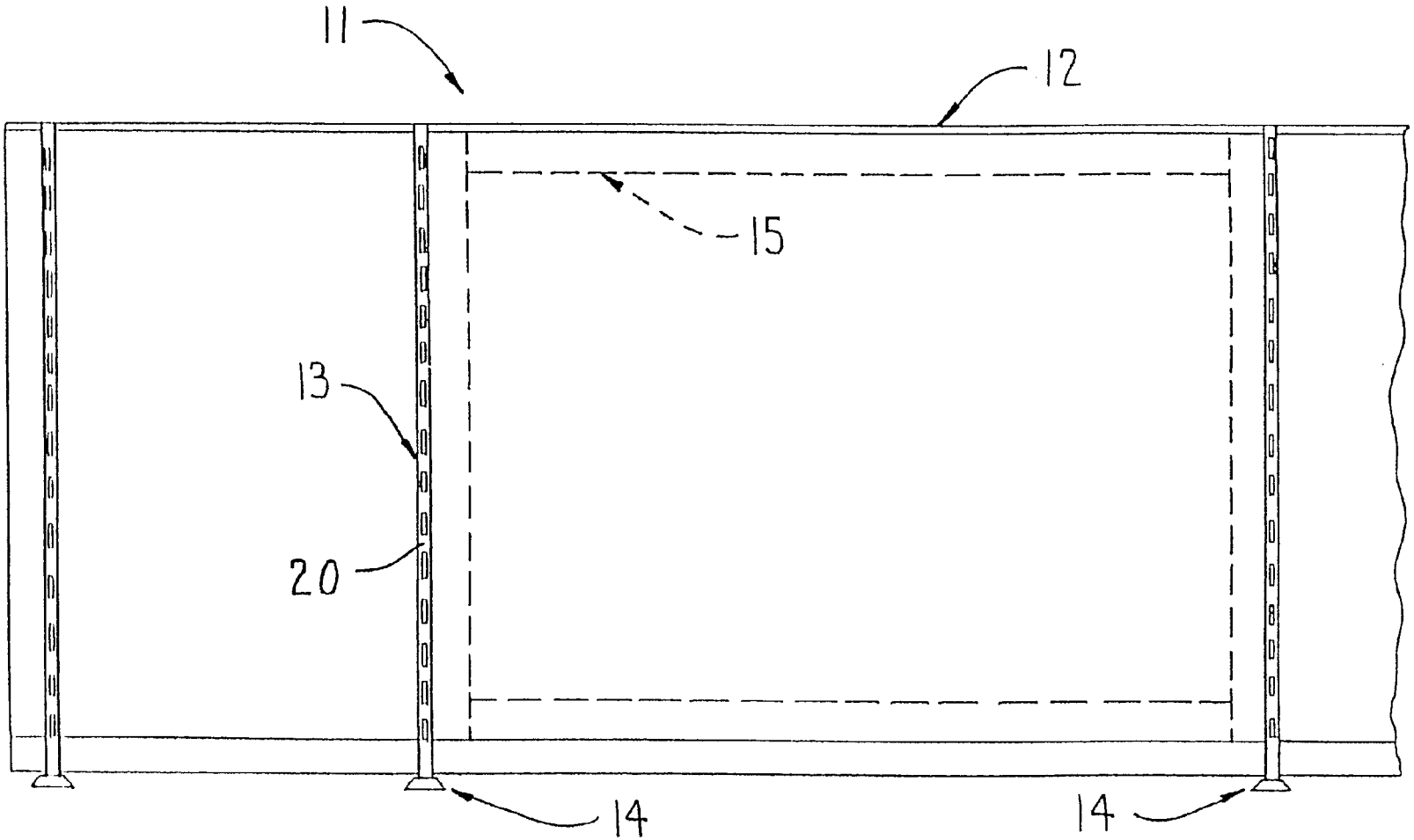
FIG. 1 is a side elevational view which illustrates several panel assemblies joined together to define at least part of an upright space-dividing wall system.
Figure 5:
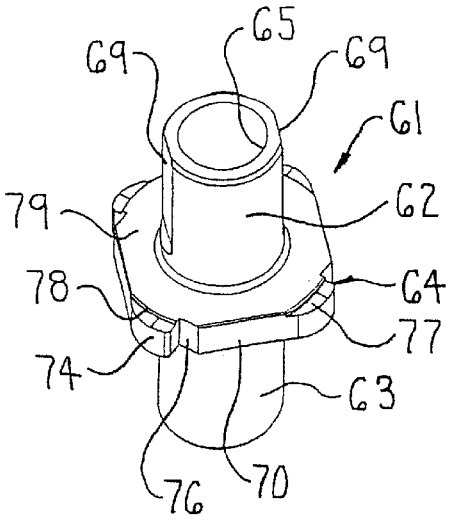
FIG. 5 is an enlarged perspective view of the housing of the glide assembly.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Referring to FIG. 1, there is illustrated an upright space-dividing wall system 11, which system 11 is formed from a plurality of upright space-dividing panel assemblies 12 joined together in a series arrangement to define individual workstations. The panel assemblies 12 are typically joined in either aligned (i.e. end-to-end) relationship, or in perpendicular relationship with end edges of two panel assemblies 12 being disposed closely adjacent one another, such arrangements being conventional. The individual panel assemblies 12 typically have a height which is significantly less than floor-to-ceiling height, whereby the panel assemblies 12 are supported on and project upwardly from the floor, with upper edges of the panel assemblies 12 being spaced downwardly a significant distance from the ceiling. The sizes of such panel assemblies, in terms of widths and heights, are conventional. In the illustrated space-dividing wall system 11, each pair of adjacent aligned panel assemblies 12 are connected together by a connector post arrangement 13 which mounts therein a glide assembly 14 according to the invention.

Each panel assembly has large width and height dimensions as compared to the thickness dimension thereof, and each typically includes a generally rectangular and ring-like frame 15 (shown in dotted lines in FIG. 1) including horizontally elongated top and bottom frame members and vertically elongated side frame members. The ring-like frame 15 surrounds and confines a core structure, which core structure is then covered by plate-like side members typically covered in fabric.

Considering now the connector post arrangement 13, this arrangement 13 includes a vertically elongate and generally tubular support element or post 20, which is designed to connect between the upright side frame members of two adjacent panel assemblies 12. The post 20 includes a pair of generally parallel side walls 21 which face the respective side frame members of two serially adjacent panel assemblies 12 when the post 20 is interposed therebetween, and two face walls 22 which extend transversely between and interconnect the side walls 21. Each of the side walls 21 defines therein a pair of vertically spaced openings 23 at least adjacent the upper ends thereof, only one pair of which is shown in FIG. 2. The openings 23 are utilized to interconnect the respective panel assemblies 12 to the opposite side walls 21 of the post 20 via panel locks (not shown) supported on the respective panel assemblies 12 as described in detail in U.S. Pat. No. 6,112,485, which is hereby incorporated by reference in its entirety herein.

Figure 13:
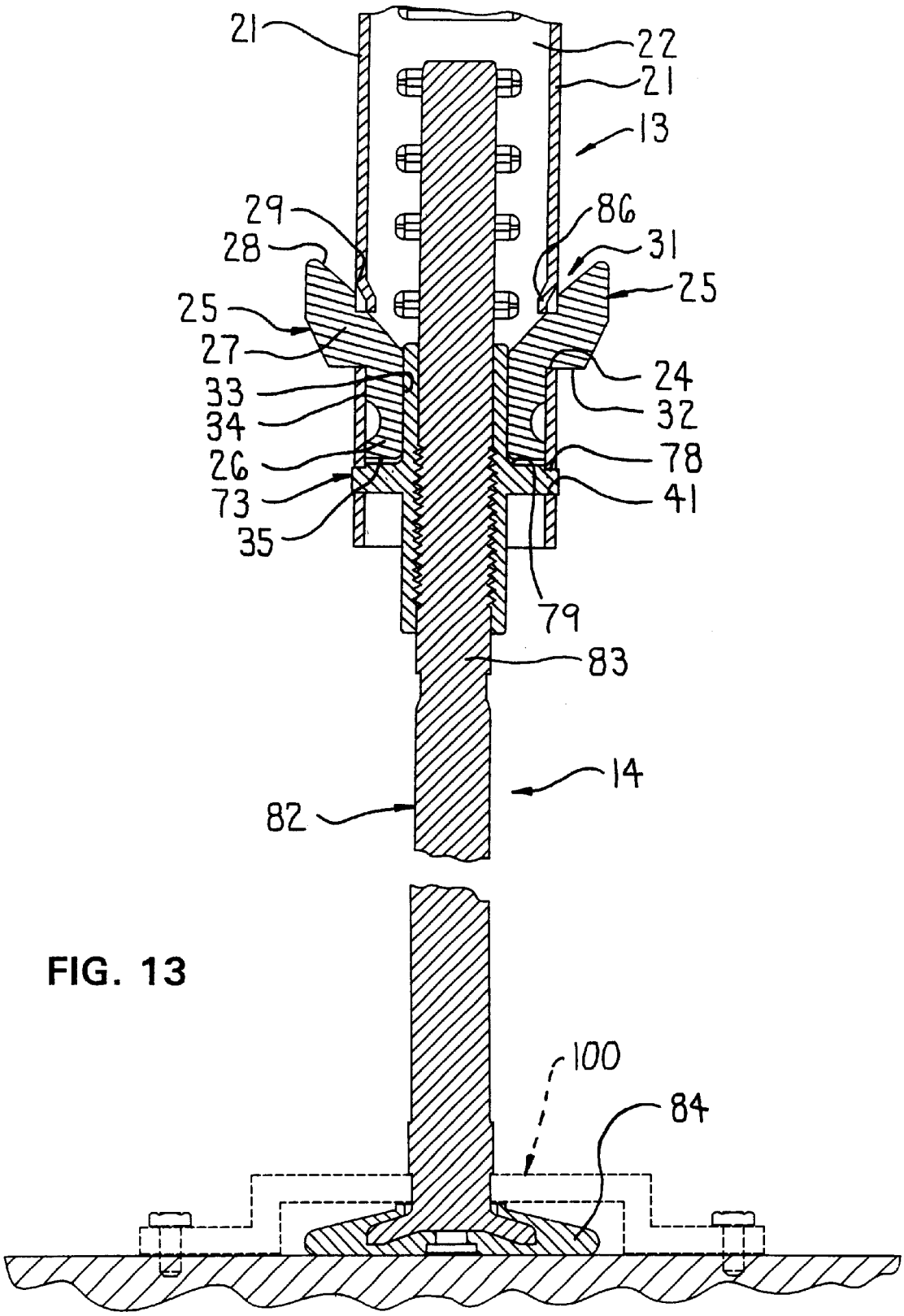
FIG. 13 is an enlarged longitudinal cross-sectional view of the connector post and glide assembly.

At the lower region of each side wall 21, an opening 24 is defined, each of which receives an arm or connector 25 which when installed on the post 20 (see FIG. 9), extends outwardly and then upwardly from the respective side wall 21. The connectors 25 are identical to one another and only one of which will be described in detail herein. With reference to FIG. 13, connector 25 is defined by a lower base body 26 and a hook 27 which extends horizontally outwardly and then vertically upwardly from base body 26. The hook 27 includes a beveled surface 28 thereon, and the lower edge of surface 28 terminates at a shoulder 29 which along with the upper edge of opening 24 defines an access opening of a horizontally extending and upwardly opening channel 31 which is also open at opposite ends thereof. The hook 27 additionally defines a generally horizontally oriented and flat lower surface 32. As shown in FIG. 13, base body 26 defines thereon a generally vertically oriented and generally flat inner surface 33, an outer surface 34 opposite inner surface 33 which at an upper edge thereof intersects lower surface 32, and a generally flat and horizontally oriented lower surface 35.

Referring to FIGS. 3 and 4, a first pair of identical slots 40 are provided in the lower portions of the respective face walls 22 of connector post 20, and a second pair of identical slots 41 are provided in the lower portions of the respective side walls 21. The slots 40 and 41 are horizontally elongated and extend transversely across a significant portion of the respective face and side walls 22 and 21. The slots 40 are each defined by a lower horizontal edge 42, a pair of vertical and generally parallel side edges 43 which project upwardly from respective opposite ends of lower edge 42, and an upper edge 44 which extends transversely between upper ends of the respective side edges 43. As shown in FIG. 3, upper edge 44 is inclined relative to the horizontal. In the illustrated embodiment, upper edge 44 is oriented at an angle A, which is about three degrees. Portions of the slot 40 in the opposite face wall 22 can also be seen in FIG. 3, and the upper edge 44 of same is shown partially in dotted lines.

The slots 41 are each defined by a lower horizontal edge 50, a pair of vertical and generally parallel side edges 51, and an upper edge 52 which extends transversely between upper ends of side edges 51. The upper edge 52 is inclined in the same manner as edge 44 of slot 40. Each slot 41 additionally includes a corner-shaped locking tab 53 having a generally horizontal upper edge 54 which is spaced vertically downwardly from upper edge 52 and a generally upright side edge 55 which intersects upper edge 54 and is spaced horizontally inwardly from the respective side edges 51. The slot 41 in the opposite side wall 21 is partially shown in FIG. 4 and portions of the upper, lower and side edges of same are shown in dotted lines.

Referring to FIGS. 2 and 5–8, the connector post 20 incorporates therein a glide assembly 14. Glide assembly 14 includes a generally tubular housing 61 having an upper neck part 62 and a lower neck part 63 which are joined to one another through an annular lock plate or flange 64 which is cantilevered sidewardly from housing 61. A hole 65 extends completely through housing 61 along the longitudinal extent thereof, and is defined by an upper portion 66 and a lower portion 67 which are separated from one another by an intermediate portion 68 of a reduced diameter as compared to portions 66 and 67. As shown in dotted lines in FIG. 7, intermediate portion 68 is threaded. A pair of flats 69 extend longitudinally along upper neck part 62 on opposite sides thereof.

Figure 6:
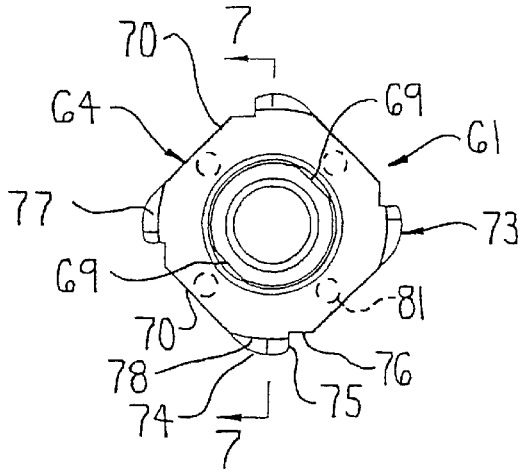
FIG. 6 is an enlarged top view of the housing of FIG. 5.
Figure 7:
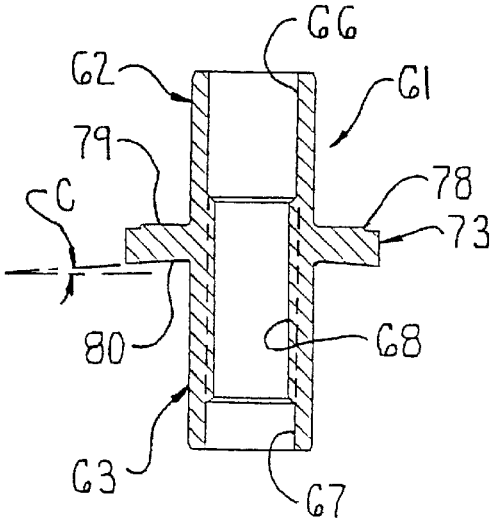
FIG. 7 is an enlarged cross-sectional view taken generally along line 7—7 in FIG. 6.
Figure 8:
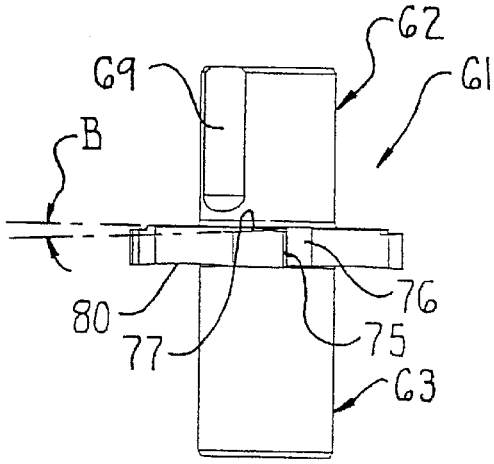
FIG. 8 is an enlarged side view of the housing of FIG. 5.

Turning now to lock plate 64 of housing 61, same has four generally vertically oriented and flat edge portions 70, opposite pairs of which are parallel to one another. As shown in FIG. 6, the flats 69 are oriented on upper neck part 62 so as to be parallel with a pair of edge portions 70 on opposite sides of lock plate 64. Lock plate 64 also includes four noses 73 spaced at approximately equal distances from one another along plate 64, with each nose 73 being disposed between an adjacent pair of edge portions 70. As the noses 73 are identical to one another, only one will be described here. Nose 73 has a rounded outer upright surface 74 which substantially smoothly adjoins a respective edge portion 70 at one end thereof and on the opposite end is joined to an upright shoulder 75. Shoulder 75 is in turn joined to a vertically oriented flat 76 which is generally perpendicular to shoulder 75. The opposite end of flat 76 merges with the adjacent edge portion 70. The upper side of the nose 73 defines an upwardly angled surface 77 thereon which is inclined at an angle B (FIG. 8) with the horizontal. In the illustrated embodiment, angle B has a value of approximately three degrees. A further vertically oriented shoulder 78 projects upwardly from nose 73 and extends along the horizontal extent thereof. Shoulder 78 extends upwardly a short vertical distance from the upper surface of nose 73 and adjoins an upper surface 79 of lock plate 64.

A lower surface 80 of lock plate 64 defines therein a plurality, here four, of downwardly opening dimples or recesses 81 (as shown in dotted lines in FIG. 6) which are utilized to install glide assembly 14 within connector post 20 as discussed below. Further, the lower surface 80 of lock plate 64 tapers or angles downwardly as same projects away from the upright side wall lower neck part 63 of housing 61. The lower surface 80 of lock plate 64 is oriented at an angle C, which in the illustrated embodiment has a value of about 5 degrees.

Glide assembly 14 additionally includes an elongate and rod-like glide stem 82 having an externally threaded upper part 83 and an enlarged lower end or foot 84 adapted for direct supportive engagement with the floor (FIG. 13).

The glide assembly 14 can be mounted to the connector post 20 as follows. The connectors 25 are positioned in the respective openings 24 at the lower end of post 20 by first inserting the base body 26 of each connector 25 sidewardly into opening 24 and then pivoting base body 26 downwardly about the lowermost edge of opening 24 so that the hook 27 is oriented generally vertically. The housing 61 is then inserted into the open lower end of post 20, and to do this the edge portions 70 of lock plate 64 which are parallel to the respective flats 69 of upper neck 62 are oriented so as to be generally parallel with the side walls 21 of post 20 to allow insertion of lock plate 64 thereinto. With the lock plate 64 oriented in this manner within post 20, the flats 69 are respectively disposed in facing and generally parallel relation with the flat inner surfaces 33 of the respective connectors 25 and along with the upper surface 79 of lock plate 64, serve to loosely hold the connectors 25 in position within post 20. The flats 69 provide the necessary clearance for the upper neck part 62. This initial assembly position of housing 61 within post 20 is illustrated in FIG. 11.

When the noses 73 of lock plate 64 are aligned vertically with the respective slots 40 and 41 in post 20, a driving tool, for example a spanner wrench having four pin-like projections, is inserted into the open lower end of post 20 so that the pins engage within dimples 81, and the housing 61 and lock plate 64 are rotated approximately forty-five degrees in a clockwise direction from the position illustrated in FIG. 11 which causes outward deflection of tabs 53 by the pair of noses 73 which are moved into adjacent relationship with the respective side walls 21 of post 20. Continued rotation of the lock plate 64 causes the noses 73 adjacent side walls 21 to move past the locking tabs 53 so that the forward portions of these noses 73 are wedged into the respective slots 41, and the forward portions of the opposite pair of noses 73 are wedged into the respective slots 40. Further, the rotation of the lock plate 64 from the position illustrated in FIG. 11 causes the flats 69 of upper neck part 62 to move away from the respective surfaces 33 of connectors 25, and thus the rounded outer surface of the upper neck 62 of housing 61 (located between the flats 69) engages the inner surfaces 33 of the connectors 25 which forces the respective base bodies 26 outwardly so that the outer surfaces 34 thereof snugly engage the inside surfaces of the respective walls 21, and the lower surface 32 of the respective connectors 25 are seated on the lower edges of the respective openings 24.

During the rotation of lock plate 64 from the position illustrated in FIG. 11, the pair of noses 73 which are moved into adjacent relationship with the respective side walls 22 first engage within the vertically wider portions of the respective slots 40 (i.e. the rightmost portion in FIGS. 3 and 9), and with continued rotation of plate 64 are wedged into the narrower portions of slots 40 (i.e. the leftmost portion in FIGS. 3 and 9). Likewise, the forwardmost portions of noses 73 adjacent side walls 21, after passing the respective locking tabs 53, are wedged into the leftmost portions of the slots 41 (FIG. 4). It will be appreciated that the angled surfaces 77 of the respective noses 73 which have the same taper as the upper edges 44 and 52 of slots 40 and 41, respectively, act as guides during rotation of the lock plate 64 and facilitate movement of the noses 73 into slots 40 and 41. Further, the curved outer upright surfaces 74 of the respective noses 73 facilitate smooth engagement of the noses 73 with the inner surfaces of the tabs 53 during rotation of plate 64.

The locking tabs 53 on the respective side walls 21 are then deformed back inwardly so that the shoulders 75 of the corresponding noses 73 engage or abut the respective upright side edges 55 of tabs 53, and the upper edges 44 and 52 of slots 40 and 41 are seated on the respective shoulders 78 of the corresponding noses 73 (see FIG. 13). This deformation of the tabs 53 can be achieved by compressing or crimping the post 20 from opposite sides (i.e. at the lower ends of side walls 21). The wedging of the forwardmost ends of the respective noses 73 in the slots 40 and 41 prevents further rotation of the lock plate 64 in a clockwise or forward direction, and the engagement of the shoulders 75 with the tabs 53 prevents counterclockwise or reverse (i.e. release) rotation of the lock plate 64 relative to post 20. FIG. 12 illustrates the housing 61 in this locked position within connector post 20. With the lock plate 64 in position within connector post 20 as described above, the connectors 25 are held in position within the respective openings 24 by the upper neck 62 of housing 61 and are vertically supported through the engagement of the lower surfaces 32 of connectors 25 with the lowermost edges of the respective openings 24 of post 20.

The glide stem 82 is then assembled to the post 20 by inserting the upper part 83 thereof into the lower open end of housing 61 and rotating stem 82 to engage the threads of upper part 83 with the threads of the intermediate portion 68 of housing 61. In the illustrated embodiment, the uppermost end of stem 82 projects upwardly into the interior of the post 20 vertically beyond the upper ends of connectors 25.

With the glide assembly 14 mounted on the connector post 20 in the manner discussed above, two panel assemblies 12 can be secured in aligned relationship as shown in FIG. 1 utilizing a single connector post arrangement 13. The connector post 20 cooperates directly between the adjacent upright edge frames of two panel assemblies 12 to rigidly join same to one another. The lower corners of the panel assemblies 12 are seated within the respective channels 31 defined by the connectors 25, and the upper regions of the panel assemblies 12 are secured to the respective side walls 21 of post 20 utilizing panel locks (not shown) which cooperate with the pairs of openings 23 on opposite sides of the post 20. The attachment of the respective panel assemblies 12 to the connector post 20 utilizing these panel locks is described in detail in the '485 patent referenced above. It will be appreciated that the vertical height of the connector post 20 can be adjusted by rotating glide stem 82 within housing 61 to the appropriate position. Further, the beveled surfaces 28 of the respective connectors 25 facilitate insertion of the edge frames of the respective panel assemblies 12 into channels 31.

With each pair of aligned panel assemblies 12 joined through a single connector post 20, the post 20 is sandwiched between the edges of the respective panel assemblies 12. In this regard, the face walls 22 of post 20 each define therein a plurality of slot-like openings 85 so that conventional hangers associated with furniture components or accessories such as cabinets can be positioned adjacent the side surface of the panel assembly 12.

The connector post 20 and glide assembly 14 according to the invention simplifies the panel system assembly process by providing a secure connection between the glide assembly 14 and the post 20 as well as between the panel-supporting connectors 25 and the post 20 without the need for welding.

Further, in areas where earthquakes are a threat, the lower end of the post arrangement 13 can be secured to the floor by a plate 100 as shown in dotted lines in FIG. 13. Thus, if a large upwardly oriented vertical load is applied to the connector post 20 such as a force produced by an earthquake, the downwardly tapered configuration of lock flange 64 tends to pull the side walls 21 and face walls 22 of post 20 inwardly to effectively prevent disengagement of the noses 73 from the slots 40 and 41.

In addition, in the event that the panel assembly 12 having the connector post arrangement 13 and glide assembly 14 mounted thereon is dropped, as can occur during assembly or disassembly of a panel system, upper edges 86 of the openings 24 of the post 20 in the illustrated embodiment are deformed or dimpled (see FIG. 13). This deformation serves to transfer some of the downward load from the connectors 25 to the post 20, and allows the upright edge frame of the panel assembly 12 to deform into the opening defined by the dimples.

It will be appreciated that the glide assembly 14 according to the invention may be utilized in panel arrangements which do not utilize intermediate connector posts such as post 20 discussed above. In this regard, the glide assembly 14 may be mounted to the lower end of a vertical edge frame of a panel assembly, provided that the lower end of the edge frame is configured to accept glide assembly 14 in a similar manner as post 20.

It will also be appreciated that the locking tabs 53 of slots 41 may have alternative configurations. For example, the tab may project downwardly from upper edge 52 adjacent the rightmost edge of slot 41 and be spaced horizontally from both side edges 51, or the tab may project horizontally inwardly from the right side edge 51 of slot 41 so that the tab is spaced slightly upwardly from lower edge 50 and slightly downwardly from upper edge 52.

Although a particular preferred embodiment of the invention has been disclosed in detail for illustrative purposes, it will be recognized that variations or modifications of the disclosed apparatus, including the configuration and rearrangement of parts, lie within the scope of the present invention.

What is claimed is:

1. A space-dividing wall panel system comprising:

first and second portable upright panel assemblies each having a vertically elongate upright end edge and a pair of oppositely facing and generally upright side surfaces which extend transversely relative to the respective said end edges;

a vertically elongate support post interposed between the respective end edges of said first and second panel assemblies, said support post having a lower end with a generally tubular configuration which opens downwardly, said lower end defining therein a pair of tapered openings respectively disposed in opposite side walls of said lower end; and a glide assembly disposed within said lower end of said support post, said glide assembly including a housing and an elongate stem projecting downwardly therefrom for supportive engagement with a floor, said housing mounting thereon a generally sidewardly projecting flange, said flange defining thereon a pair of projections on opposite sides thereof which project generally sidewardly into and are wedged within the respective said openings of said support post to fix said glide assembly thereto.

2. The panel system of claim 1 wherein a tab is defined on each said side wall adjacent said opening thereof and is disposed in abutting contact with one of said projections, wherein said projections are wedged within narrow portions of said slots to prevent rotation of said housing relative to said post in a first direction, and said tabs prevent rotation of said housing relative to said post in a second direction which is opposite said first direction.

3. The panel system of claim 2 wherein said narrow portion of each said slot is disposed at one end thereof and said tab of each said slot is disposed at an opposite end thereof such that said narrow portion and said tab engage opposite ends of the corresponding projection.

4. The panel system of claim 1 wherein said lower end has four of said side walls arranged in a rectangular configuration with each said side wall defining therein a said tapered opening, said flange having a four-sided generally rectangular configuration with a said projection being disposed between each adjacent pair of said sides, said flange being disposed within said lower end in cocked relation relative thereto such that each said projection is disposed approximately midway along one of said side walls within the corresponding said opening.

5. The panel system of claim 4 wherein the wedging of said projections within said slots prevents rotation of said flange relative to said post in a first direction, and an opposed pair of said side walls each define a tab thereon immediately adjacent the respective opening which engages with a portion of the corresponding said projection to prevent rotation of said flange relative to said post in a second direction opposite said first direction.

6. The panel system of claim 1 wherein a tab is defined on at least one of said side walls adjacent said opening thereof which is deformed outwardly due to contact with one of said projections during assembly of said housing to said post, said tab being deformed back inwardly for engagement with a shoulder defined on said one projection to prevent rotation of said housing relative to said post.

7. The panel system of claim 6 wherein said housing defines therein a downwardly opening bore, said stem having an upper portion threadingly engaged within said bore and having an enlarged lower foot portion disposed in supportive engagement with a floor.

8. The panel system of claim 1 wherein a pair of connector arms are supported on said lower end of said post, each said connector arm having a hook part which projects through an opening defined in said lower end of said post such that said hook parts project upwardly from opposite sides of said post and respectively supportingly engage lower ends of said panel assemblies, each said connector arm having a base portion disposed within said post, and said housing having a neck part which projects upwardly from said flange between said base portions and supportingly engages the respective base portions.

9. A support arrangement for a wall panel system including at least one upright panel assembly having a vertically elongate upright end edge, said arrangement comprising:

an upright support element associated with the end edge of the wall panel assembly, said support element having a generally tubular configuration and a lower end, said lower end defining at least one slot-like opening and a tab disposed closely adjacent said opening; and a glide assembly mounted within said lower end of said support element, said assembly including a lock plate defining thereon a nose which projects through said opening of said support element, said tab being disposed to prevent disengagement of said nose from said opening, and an elongate floor-engaging portion which projects downwardly from said flange.

10. The support arrangement of claim 9 wherein said opening is defined in an upright side wall of said support element and projects completely therethrough, said opening having a tapered configuration such that said nose is wedged within said opening.

11. The support arrangement of claim 9 wherein said support element includes a pair of generally parallel side walls disposed in opposed relation with one another, each said side wall defining a said slot-like opening therein, said lock plate defining thereon a pair of said noses disposed on opposite sides thereof, said openings each having a tapered configuration wherein said noses extend through said openings and are wedged therein to secure said glide assembly to said support element.

12. The support arrangement of claim 11 wherein a said tab is defined closely adjacent each said opening and is deformed inwardly during mounting of said glide assembly to said support element so as to engage the corresponding said nose and secure said glide assembly to said support element.

13. The support arrangement of claim 12 wherein each said opening has a generally horizontally oriented lower edge, a pair of upright and spaced apart end edges, and an upper edge extending between said end edges and spaced upwardly from said lower edge, and the corresponding tab has an upper generally horizontal edge which projects sidewardly and inwardly from one of said end edges and then vertically downwardly so as to adjoin said lower edge, said upper edge of said opening being inclined relative to the horizontal and angling downwardly as same projects away from said tab so as to define a narrow portion of said opening adjacent the other said end edge, and each said nose has an upper surface which is inclined similarly to said upper edge of said opening such that said upper surface guides said nose towards said narrow portion of said opening during mounting of said glide assembly to said support element.

14. A wall panel arrangement comprising:

a wall panel assembly having a pair of generally vertically oriented side surfaces and an upright end portion oriented transversely relative to said side surfaces;

an upright support member connected to said wall panel assembly adjacent said end portion thereof and having a first pair of opposed side walls and a second pair of opposed side walls extend transversely between and interconnecting said first pair of side walls, said first pair of side walls each defining therein a horizontally elongated slot adjacent a lower edge thereof; and a glide assembly mounted to a lower end of said support member and disposed in supportive engagement with a floor, said glide assembly having an upper mounting part and a lower stem which projects downwardly from said mounting part and engages the floor, said mounting part being disposed within said lower end of said support member and including a flange cantilevered sidewardly therefrom which defines a pair of projections which upon rotation of said mounting part relative to said support member are wedged within the respective said slots of said first side walls to secure said glide assembly to said support member.

15. The wall panel arrangement of claim 14 wherein said mounting part has a generally tubular configuration and defines a threaded bore therein, said stem being threadingly engaged within said bore to permit height adjustment of said support member.

16. The wall panel arrangement of claim 14 wherein said slots each have a tapered configuration.

17. The wall panel arrangement of claim 16 wherein said first side walls each define thereon a retaining element disposed closely adjacent the respective slot, wherein said projections are wedged within narrow portions of the respective slots to prevent rotation of said mounting part relative to said support element in a first direction, and said retaining elements are disposed to prevent said mounting part from rotating relative to said support element in a second direction opposite said first direction.

18. A method of assembling a glide arrangement to a space-dividing wall panel system, said method comprising the steps of:

providing an elongate support post having an open lower end and a pair of opposed side walls each defining therein a horizontally elongated slot adjacent said lower end and a pair of tabs disposed adjacent the respective slots;

providing a glide arrangement including a housing mounting thereon a sidewardly projecting lock plate defining a pair of noses disposed on opposite sides thereof, and a stem defining thereon an enlarged foot for supportive engagement with a floor;

inserting said housing upwardly into said lower end of said support post;

rotating said housing relative to said support post such that said noses respectively deform said tabs outwardly as said noses move past same and engage within the respective slots; and deforming said tabs back inwardly to engage same with the respective noses to lock the housing to the support post.

19. The method of claim 18 further including the steps of providing the slots with a tapered configuration, and said step of rotating said housing includes wedging said noses within the tapered slots.

20. The method of claim 19 further including threadingly engaging the stem within a threaded opening defined within the housing such that the stem projects downwardly from the housing.

21. The method of claim 18 wherein said step of rotating includes rotating the housing within the support post such that the lock plate is oriented in cocked relation relative to the side walls of the support post.

* * * * *